US005607829A

United States Patent [19]

Oya et al.

[11] Patent Number: 5,607,829

[45] Date of Patent: Mar. 4, 1997

[54] SILVER HALIDE PHOTOGRAPHIC MATERIAL

[75] Inventors: Toyohisa Oya; Yoshio Inagaki; Takahiro Goto, all of Kanagawa, Japan

[73] Assignee: Fuji Photo Film Co., Ltd., Kanagawa, Japan

[21] Appl. No.: 579,408

[22] Filed: Dec. 27, 1995

[30] Foreign Application Priority Data

Dec. 28, 1994 [JP] Japan ..... 6-327026

[51] Int. Cl.[6] ..... G03C 1/22

[52] U.S. Cl. ..... 430/578; 430/577; 430/592

[58] Field of Search ..... 430/578, 592, 430/577

[56] References Cited

U.S. PATENT DOCUMENTS

| | | | |
|---|---|---|---|
| 2,839,403 | 6/1958 | Knott | 430/578 |
| 2,839,404 | 6/1958 | Knott | 430/578 |
| 4,057,430 | 11/1977 | Sato et al. | 430/543 |

FOREIGN PATENT DOCUMENTS

| | | |
|---|---|---|
| 54-34532 | 10/1979 | Japan . |
| 55-45015 | 3/1980 | Japan . |

*Primary Examiner*—Lee C. Wright

*Attorney, Agent, or Firm*—Sughrue, Mion, Zinn, Macpeak & Seas

[57] ABSTRACT

A silver halide photographic material is described, which contains at least one compound represented by the following formula (I):

(I)

wherein Z represents an atomic group necessary for forming a 5- or 6-membered nitrogen-containing heterocyclic ring, $R_1$ represents an alkyl group, $R_2$ represents a hydrogen atom, an alkyl group, an aryl group or a heterocyclic group, $R_3$ represents a nitrogen-containing 5-membered heterocyclic ring, $L_1$ and $L_2$ each represents a methine group and n represents 0 or an integer of 1 to 3.

2 Claims, No Drawings

SILVER HALIDE PHOTOGRAPHIC MATERIAL

FIELD OF THE INVENTION

The present invention relates to a silver halide photographic material spectrally sensitized with a novel merocyanine dye, more particularly, it relates to an ultra-high contrast silver halide photographic material for use in the photomechanical process.

BACKGROUND OF THE INVENTION

In the field of photomechanical process, in order to cope with diversification and complexity of printed matters, a photographic material having good original reproducibility, stabilization of processing solutions or simplification of replenishing methods have been demanded.

In particular, an original for the line camera work is fabricated by pasting therein phototypesetting letters, handwritten letters, illustrations and photographs as a halftone image. As a result, a mixture of images different in the density or line width is included in the original and a process camera, a photographic material and an image formation method capable of finishing up the work in good reproduction from the original are keenly demanded. On the other hand, in plate making of a catalogue or a large-size posture, a halftone photograph is very often enlarged (texture expansion) or shrunk (texture contraction). When the print making uses an enlarged halftone photograph, the screen ruling is roughened to result in photographing of out-of-focus dots, whereas in case of shrinking, the screen ruling per inch increases more than that of the original to result in photographing of thin dots. Accordingly, in order to maintain the reproducibility of halftone gradation, an image formation method ensuring further broader latitude is being demanded.

As a system for meeting the requirement for broader latitude, a method is known where a lith-type silver halide light-sensitive material comprising at least silver chlorobromide having a silver chloride content of 50% or more is processed with a hydroquinone-based developer suppressed in the sulfite ion effective concentration to a very low level (usually, 0.1 mol/liter or less) to obtain a line original or a halftone image having a high contrast and a high blacking density so that the image area and the non-image area can be clearly distinguished. However, according to this method, due to the low sulfite ion concentration, the developer is very susceptible to air oxidation and therefore, various efforts and designs are made so as to keep the developer activity stable in continuous use thereof.

In order to overcome such instability in image formation, an image formation system capable of providing development with a processing solution good in storage stability and achieving ultra-high photographic properties is being demanded. As one example of such a system, U.S. Pat. No. 4,166,742 proposes a system for forming an ultrahigh contrast negative image having a $\gamma$ value exceeding 10 where a surface latent image-type silver halide photographic material having added thereto a specific acylhydrazine compound is processed with a developer containing a sulfite ion as a preservative and having a pH of from 11.0 to 12.3. This image formation system provides superior effects with respect to sharp halftone dot quality, processing stability, rapid processability and original reproducibility.

However, since the developer used in this image formation system is designed to have a relatively high pH so as to obtain a high contrast image, a defect is present that fog is readily caused. In order to suppress the generation of fog, JP-A-61-213847 (the term "JP-A" as used herein means an "unexamined published Japanese patent application") discloses a technique for improving the image quality to an extreme extent by incorporating a redox compound capable of releasing a development inhibitor upon oxidation into the photographic material.

On the other hand, it is known to use a certain kind of merocyanine dyes as a spectral sensitizing dye of a photographic emulsion as disclosed, for example, in U.S. Pat. Nos. 3,480,439 and 3,625,698. Further, as a sensitizing dye having properties capable of giving a contrast and sharp halftone image, JP-A-55-45015 discloses a dimethinemerocyanine dye having a thiohydantoin ring substituted by a pyridyl group and JP-B-54-34532 (the term "JP-B" as used herein means an "examined Japanese patent publication") discloses a dimethinemerocyanine dye having a thiohydantoin ring substituted by a phenyl group. However, the silver halide photographic material containing such a merocyanine dye is in practice low in the sensitivity and contrast and bad in storage stability or bound to such a defect that residual dye stain after development processing is readily generated. Accordingly, coming out of a spectral sensitizing dye free of such defects has been keenly demanded.

SUMMARY OF THE INVENTION

A first object of the present invention is to provide a high-quality silver halide photographic material high in the sensitivity and also in the contrast and good in the storage stability. A second object of the present invention is to provide a silver halide photographic material reduced in residual dye stain after the development processing.

As a result of intensive investigations, the above-described objects of the present invention can be achieved by a silver halide photographic material comprising a support having provided thereon at least one light-sensitive silver halide emulsion layer, said at least one light-sensitive silver halide emulsion layer containing at least one compound represented by the following formula (I):

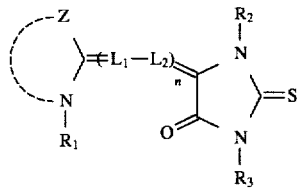

(I)

wherein Z represents an atomic group necessary for forming a 5- or 6-membered nitrogen-containing heterocyclic ring, $R_1$ represents an alkyl group, $R_2$ represents a hydrogen atom, an alkyl group, an aryl group or a heterocyclic group, $R_3$ represents a nitrogen-containing 5-membered heterocyclic ring, $L_1$ and $L_2$ each represents a methine group and n represents 0 or an integer of 1 to 3.

DETAILED DESCRIPTION OF THE INVENTION

The formula (I) is described below in greater detail.

$R_1$ is preferably an unsubstituted alkyl group having from 1 to 18, preferably from 2 to 10 carbon atoms (e.g., methyl, ethyl, n-propyl, isopropyl, n-butyl, n-pentyl, n-hexyl, n-octyl, n-decyl, n-dodecyl, n-octadecyl) or a substituted alkyl group. $R_1$ may be combined with the methine group in L to form a ring. Examples of the substituent include a carboxy group, a sulfo group, a cyano group, a halogen atom (e.g., fluorine, chlorine, bromine, iodine), a hydroxy group, an alkoxycarbonyl group having from 2 to 10, preferably from 2 to 8 carbon atoms (e.g., methoxycarbonyl, ethoxycarbonyl, benzyloxycarbonyl), an alkoxy group having from 1 to 16, preferably from 1 to 8 carbon atoms (e.g., methoxy, ethoxy, benzyloxy, phenethyloxy), an aryloxy group having from 6 to 12, preferably from 6 to 10 carbon atoms (e.g., phenoxy, p-tolyloxy), an acyloxy group having from 2 to 6, preferably from 2 to 4 carbon atoms (e.g., acetyloxy, propionyloxy), an acyl group having from 2 to 12, preferably from 2 to 8 carbon atoms (e.g., acetyl, propionyl, benzoyl, mesyl), a carbamoyl group having from 1 to 10, preferably from 1 to 5 carbon atoms (e.g., carbamoyl, N,N-dimethylcarbamoyl, morpholinocarbonyl, piperidinocarbonyl), a sulfamoyl group having from 0 to 10, preferably from 0 to 5 carbon atoms (e.g., sulfamoyl, N,N-dimethylsulfamoyl, morpholinosulfonyl, piperidinosulfonyl) and an aryl group having from 6 to 18, preferably from 6 to 10 carbon atoms (e.g., phenyl, 4-chlorophenyl, 4-methylphenyl, α-naphthyl). $R_1$ is more preferably an unsubstituted alkyl group (e.g., methyl, ethyl, n-propyl, n-butyl), a carboxyalkyl group (e.g., 2-carboxyethyl, carboxymethyl), a sulfoalkyl group (e.g., 2-sulfoethyl, 3-sulfopropyl, 4-sulfobutyl, 3-sulfobutyl) or a methanesulfonylcarbamoylmethyl group.

The 5- or 6-membered nitrogen-containing heterocyclic ring completed by Z may be condensed with another ring, may be saturated or unsaturated or may contain a hetero atom other than the nitrogen atom such as an oxygen atom, a sulfur atom, a selenium atom or tellurium atom. Preferred examples of the ring include a benzothiazole nucleus, a benzoxazole nucleus, a benzoselenazole nucleus, a benzotellurazole nucleus, a 2-quinoline nucleus, a 4-quinoline nucleus, an isoquinoline nucleus, a pyridine nucleus, an indolenine nucleus, a benzimidazole nucleus, a naphthothiazole nucleus, a naphthoxazole nucleus, a naphthoselenazole nucleus, a naphthotellurazole nucleus, a naphthoimidazole nucleus, an oxazole nucleus, a thiazoline nucleus, a selenazoline nucleus, an indoline nucleus, an oxazoline nucleus, an oxadiazole nucleus, a thiadiazole nucleus, a tetrazole nucleus, a thiazole nucleus, a selenazole nucleus, an imidazole nucleus, an imidazo[4,5-b]-quinoxaline nucleus and pyrimidine nucleus. Among these, more preferred are an oxazole nucleus, a benzoxazole nucleus, a naphth[1,2-d] oxazole, a naphth[2,1-d]oxazole nucleus, a naphth[2,3-d] oxazole nucleus, an oxazoline nucleus and a thiazoline nucleus, and most preferred is a benzoxazole nucleus. These nitrogen-containing heterocyclic ring each may have a substituent and specific examples of the substituent include a halogen atom (e.g., fluorine, chlorine, bromine), an unsubstituted alkyl group having from 1 to 12, preferably from 1 to 6 carbon atoms (e.g., methyl, ethyl, n-propyl, isopropyl, n-butyl, n-hexyl), an alkoxy group having from 1 to 6, preferably from 1 to 4 carbon atoms (e.g., methoxy, ethoxy, propoxy, isopropoxy), a hydroxy group, an alkoxycarbonyl group having from 2 to 12, preferably from 2 to 5 carbon atoms (e.g., methoxycarbonyl, ethoxycarbonyl), an alkylcarbonyloxy group having from 2 to 10, preferably from 2 to 5 carbon atoms (e.g., acetyloxy, propionyloxy), a phenyl group, a hydroxyphenyl group, a group having an amido group and an aromatic ring at the same time and having from 3 to 15, preferably from 5 to 10 carbon atoms (e.g., p-acetylaminophenyl, m-acetylaminophenyl, 2-pyrrolcarboxyamido, m-hydroxybenzamido, 2,6-dihydroxybenzamido, 2-furancarboxyamido, 2-thiophenecarboxyamido), a furyl group and a pyrrolyl group.

$R_2$ is a hydrogen atom, an unsubstituted or substituted alkyl group, an unsubstituted or substituted alkenyl group having from 3 to 12, preferably from 3 to 8 carbon atoms (e.g., allyl, 2-methylallyl, 2-methyl-l-propenyl, 2-butenyl, 3-methyl-2-butenyl) or an unsubstituted or substituted aryl group having from 5 to 12 carbon atoms (e.g., phenyl, tolyl, m-cyanophenyl, p-cyanophenyl, p-hydroxyphenyl, o-hydroxyphenyl, p-aminophenyl, o-nitrophenyl). Preferred examples of the unsubstituted alkyl group include a methyl group, an ethyl group, a propyl group, a butyl group with the ethyl group being more preferred. Examples of the substituted alkyl group include an alkoxycarbonylalkyl group having from 3 to 12, preferably from 3 to 7 carbon atoms (e.g., methoxycarbonylmethyl, ethoxycarbonylmethyl, ethoxycarbonylethyl), a hydroxyalkyl group having from 1 to 6, preferably from 1 to 4 carbon atoms (e.g., 2-hydroxyethyl, 2-hydroxypropyl, 3-hydroxypropyl, 2,3-dihydroxypropyl), a hydroxyalkoxyalkyl group having from 2 to 10, preferably from 2 to 6 carbon atoms (e.g., hydroxymethoxymethyl, 2-(2-hydroxyethoxy)ethyl, 2-hydroxyethoxyethyl), a carbamoylalkyl group having from 2 to 12, preferably from 2 to 8 carbon atoms (including a substituted carbamoylalkyl group which is N-alkyl-substituted, N,N-dialkyl-substituted, N-hydroxyalkyl-substituted, N-alkyl-N-hydroxyalkyl-substituted or N,N-di(hydroxyalkyl)-substituted and a carbamoylalkyl group of 5- or 6-membered cyclic amine, e.g., 2-carbamoylethyl, 2-N-(2-hydroxyethyl)carbamoylethyl, N,N-di(2-hydroxyethyl)carbamoylmethyl, N,N-di(2-hydroxyethyl)carbamoylethyl, N,N-dimethylcarbamoylmethyl, morpholinocarbamoylmethyl, piperidinocarbamoylmethyl), a hydroxyphenyl group (e.g., o-hydroxyphenyl, p-hydroxyphenyl, 2,6-dihydroxyphenyl) and a hydroxyalkylphenyl group having from 7 to 9 carbon atoms (e.g., p-(2-hydroxyethyl)phenyl, m-(1-hydroxyethyl)phenyl). Among these, more preferred are a hydroxyethyl group, a 2-(2-hydroxyethoxy)ethyl group and a 2-hydroxyethoxyethyl group.

$L_1$ and $L_2$ each independently represents a substituted or unsubstituted methine group. Examples of the substituent include an unsubstituted or substituted alkyl group having from 1 to 8, preferably from 1 to 4 carbon atoms (e.g., methyl, ethyl, 2-carboxyethyl, cyclopropyl), a substituted or unsubstituted aryl group having from 6 to 15, preferably 6 to 10 carbon atoms (e.g., phenyl, o-carboxyphenyl), an alkoxy group having from 1 to 8, preferably from 1 to 4 carbon atoms (e.g., methoxy, ethoxy), a halogen atom (e.g., chlorine, bromine, fluorine), an amino group, a substituted amino group having from 1 to 20, preferably from 1 to 14 carbon atoms (e.g., N,N-diphenylamino, N-methyl-N-phenylamino, N-methylpiperazino) and a carboxy group, an alkylthio group having from 1 to 6, preferably from 1 to 3 carbon atoms (e.g., methylthio, ethylthio). $L_1$ and $L_2$ may form together an auxochrome or a ring.

n is preferably 0, 1, 2 or 3, more preferably 0, 1 or 2.

The nitrogen-containing 5-membered heterocyclic ring represented by $R_3$ is a saturated or unsaturated nitrogen-containing 5-membered heterocyclic ring which may further be condensed with other ring or may contain an oxygen atom, a sulfur atom, a selenium or a tellurium atom as a hetero atom other than the nitrogen atom. $R_3$ is preferably an unsaturated nitrogen-containing 5-membered heterocyclic ring. Examples of $R_3$ include a substituted or unsubstituted 2-pyrrolyl group, a substituted or unsubstituted 3-pyrrolyl group, a substituted or unsubstituted 2-oxazolyl group, a substituted or unsubstituted 4-oxazolyl group, a substituted or unsubstituted 5-oxazolyl group, a substituted or unsubstituted 3-isooxazolyl group, a substituted or unsubstituted 4-isooxazolyl group, a substituted or unsubstituted 5-isooxazolyl group, a substituted or unsubstituted 2-thiazolyl group, a substituted or unsubstituted 4-thiazolyl group, a substituted or unsubstituted 5-thiazolyl group, a substituted or unsubstituted 3-isothiazolyl group, substituted or unsubstituted 4-isothiazolyl group, a substituted or unsubstituted 5-isothiazolyl group, a substituted or unsubstituted 3-furazanyl group, a substituted or unsubstituted 2-imidazolyl group, a substituted or unsubstituted 4-imidazolyl group, a substituted or unsubstituted 5-imidazolyl group, a substituted or unsubstituted 3-pyrazolyl group, a substituted or unsubstituted 4-pyrazolyl group, a substituted or unsubstituted 5-pyrazolyl group, a substituted or unsubstituted 1,2,4-triazolyl group, a substituted or unsubstituted tetrazolyl group, a substituted or unsubstituted 1,2,3-thiadiazolyl, a substituted or unsubstituted 1,2,4-thiadiazolyl group, a substituted or unsubstituted 1,3,4-thiadiazolyl group, a substituted or unsubstituted 1,2,4-dithiazolyl group, a substituted or unsubstituted 2,1,3-thiadiazolyl group, a substituted or unsubstituted 1,2,4-oxadithiazolyl group, a substituted or unsubstituted 1,3,4-oxadithiazolyl group, a substituted or unsubstituted 2-pyrrolidinyl group, a substituted or unsubstituted 2-imidazolidinyl, a substituted or unsubstituted 3-pyrazolidinyl group, substituted or unsubstituted 2-oxazolidinyl group, a substituted or unsubstituted 3-isooxazolidinyl group, substituted or unsubstituted 2-thiazolidinyl group and substituted or unsubstituted 3-thiazolidinyl group. Among these, preferred are 2-thiazolyl group, a 4-thiazolyl group, a 2-imidazolyl group, a 4-imidazolyl group, a 3-pyrazolyl group, a 4-pyrazolyl group, a 5-pyrazolyl group, a 1,2,4-triazolyl group and a tetrazolyl group, and more preferred are a 2-thiazolyl group, a 3-pyrazolyl group and a 1,2,4-triazolyl group.

The substituent on the nitrogen-containing 5-membered heterocyclic ring may be linked either to the carbon atom or to the nitrogen atom constituting the heterocyclic ring. Examples of the substituent linked to the carbon atom include a halogen atom (e.g., fluorine, chlorine, bromine), an unsubstituted alkyl group having from 1 to 6, preferably from 1 to 3 carbon atoms (e.g., methyl, ethyl, propyl), an alkoxy group having from 1 to 8, preferably from 1 to 4 carbon atoms (e.g., methoxy, ethoxy, propoxy, isopropoxy), a hydroxy group, an alkoxycarbonyl group having from 2 to 8, preferably from 2 to 5 carbon atoms (e.g., methoxycarbonyl, ethoxycarbonyl), an alkylcarbonyloxy group having from 2 to 8, preferably from 2 to 4 carbon atoms (e.g., acetyloxy, propionyloxy), a phenyl group, a tolyl group, a hydroxyphenyl group, an amino group, a substituted amino group having from 1 to 20, preferably from 1 to 14 carbon atoms (e.g., N,N-dimethylamino, N-methyl-N-phenylamino) and a cyano group, with a halogen atom (e.g., chlorine, bromine) and an unsubstituted alkyl group (e.g., methyl, ethyl) being more preferred.

Examples of the substituent linked to the nitrogen atom include an unsubstituted alkyl group having from 1 to 10, preferably from 2 to 4 carbon atoms (e.g., methyl, ethyl, propyl, butyl), a carboxyalkyl group having from 1 to 10, preferably from 2 to 6 carbon atoms (e.g., 2-carboxyethyl, carboxymethyl), a sulfoalkyl group having from 1 to 10, preferably from 2 to 6 carbon atoms (e.g., 2-sulfoethyl, 3-sulfopropyl, 4-sulfobutyl, 3-sulfobutyl), a methanesulfonylcarbamoylmethyl group, a cyanoalkyl group having from 1 to 6, preferably from 1 to 4 carbon atoms (e.g., cyanoethyl, cyanopropyl), a halogenated alkyl group having from 1 to 10, preferably from 1 to 6 carbon atoms (e.g., trifluoromethyl, 2,2,2-trifluoroethyl), a hydroxyalkyl group having from 1 to 10, preferably from 1 to 6 carbon atoms (e.g., 2-hydroxyethyl, 2-hydroxypropyl), an alkoxycarbonylalkyl group having from 3 to 16, preferably from 3 to 8 carbon atoms (e.g., methoxycarbonylethyl, ethoxycarbonylmethyl), an alkoxyalkyl group having from 2 to 16, preferably from 2 to 8 carbon atoms (e.g., methoxyethyl, ethoxyethyl), an acyl group having from 3 to 12, preferably from 3 to 8 carbon atoms (e.g., acetyl, propionyl, benzoyl, mesyl), a carbamoyl group having from 1 to 10, preferably from 1 to 6 carbon atoms (e.g., carbamoyl, N,N-dimethylcarbamoyl, morpholinocarbonyl, piperidinocarbonyl), a sulfamoyl group having from 1 to 10, preferably from 1 to 6 carbon atoms (e.g., sulfamoyl, N,N-dimethylsulfamoyl, morpholinosulfonyl, piperidinosulfonyl), an aryl group having from 6 to 18, preferably from 6 to 10 carbon atoms (e.g., phenyl, 4-chlorophenyl, 4-methylphenyl, α-naphthyl), with an unsubstituted alkyl group (e.g., methyl, ethyl), a sulfoalkyl group (e.g., 3-sulfopropyl, 4-sulfobutyl) and an acetyl group being preferred.

Preferred combinations of the substituents represented by $R_1$, $R_2$ and $R_3$, the atomic group represented by Z and the integer represented by n include combinations where n is 0, 1 or 2 and $R_3$ is an unsaturated nitrogen-containing heterocyclic group. Among these, more preferred are combinations where Z forms a benzoxazole nucleus, still more preferred are combinations where $R_1$ is a sulfoalkyl group (e.g., 2-sulfoethyl, 3-sulfopropyl, 3-sulfobutyl, 4-sulfobutyl) and $R_2$ is a hydroxyalkoxyalkyl group (e.g., hydroxymethoxymethyl, 2-hydroxyethoxyethyl) or a hydroxyalkyl group (e.g., 2-hydroxyethyl, 2-hydroxypropyl), and most preferred are combinations where $R_3$ is a 2-thiazolyl group, a 3-pyrazolyl group (e.g., 3-pyrazolyl, 3-(5-methylpyrazolyl), 3-(4-chloro-5-methylpyrazolyl), 3-(1,2,4-triazolyl)).

Specific examples of the compound represented by formula (I) are set forth below, but the present invention is by no means limited thereto.

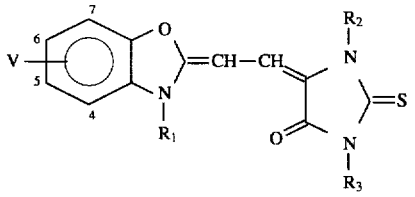

| Compound No. | V | $R_1$ | $R_2$ | $R_3$ |
|---|---|---|---|---|
| I-1 | 5-Cl | $(CH_2)_2SO_3K$ | 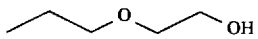 | 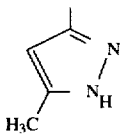 |

-continued
| | | | | |
|---|---|---|---|---|
| I-2 | 5-Cl | $(CH_2)_3SO_3K$ | 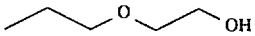 | 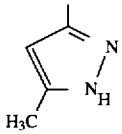 |
| I-3 | H | $(CH_2)_4SO_3Na$ | 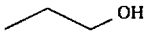 | 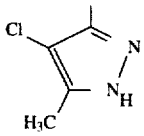 |
| I-4 | 5-F | $(CH_2)_3SO_3Na$ | $C_2H_5$ | 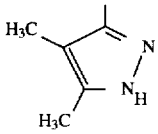 |
| I-5 | 5-Cl | $(CH_2)_2SO_3K$ | 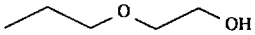 | 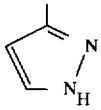 |
| I-6 | 5-$CH_3$ | $CH_2CH_3$ | $CH_2CO_2H$ | 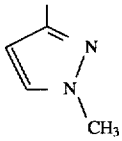 |
| I-7 | 6-$CH_3$ | $(CH_2)_4SO_3K$ | $(CH_2)_2CO_2H$ | 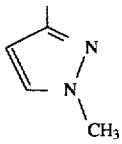 |
| I-8 | 5,6-$Cl_2$ | $(CH_2)_2OH$ | 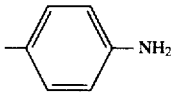 | 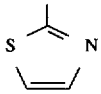 |
| I-9 | 5,6-$Cl_2$ | $(CH_2)_2SO_3Na$ | H | 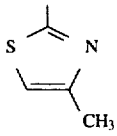 |
| I-10 | 5-Cl | $(CH_2)_3SO_3K$ | 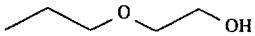 | 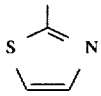 |
| I-11 | 5-Cl | $(CH_2)_2CH(CH_3)SO_3K$ | 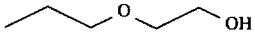 | 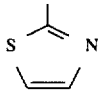 |
| I-12 | 5-$CF_3$ | $(CH_2)_3SO_3K$ | $CH_2CONH(CH_2)_2N(CH_3)_2$ | 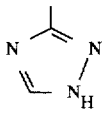 |
| I-13 | 5-Cl | $(CH_2)_4SO_3K$ | $(CH_2)_2N(CH_3)_2$ | 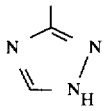 |

-continued
| | | | | |
|---|---|---|---|---|
| I-14 | 5-$COCH_3$ | $(CH_2)_3SO_3K$ | $(CH_2)_2N(CH_3)_2$ | 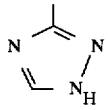 |
| I-15 | 5-Cl | $(CH_2)_2SO_3K$ | 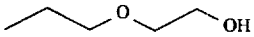 | 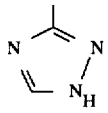 |
| I-16 | 5-$CH_3O$ | $(CH_2)_2SO_3Na$ | 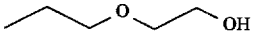 | 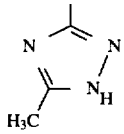 |
| I-17 | 5,6-$Cl_2$ | $(CH_2)_2CH(CH_3)SO_3K$ | $(CH_2)_2OH$ | 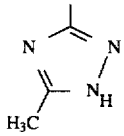 |
| I-18 | 5-Cl | $(CH_2)_3SO_3K$ | $CH_2CO_2H$ | 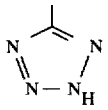 |
| I-19 | 5-$C_6H_5$ | $(CH_2)_2SO_3^{+}NH(C_2H_5)_3$ | 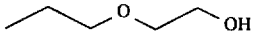 | 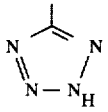 |
| I-20 | 5-F | $(CH_2)_3SO_3K$ | $CH_2CO_2H$ | 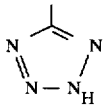 |
| I-21 | 5-Cl | $(CH_2)_3SO_3K$ | 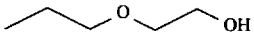 | 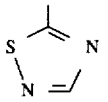 |
| I-22 | 5-Cl | $(CH_2)_3SO_3K$ | $CH_2CO_2H$ | 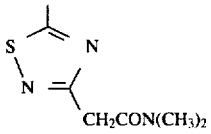 |
| I-23 | 5-Cl | $(CH_2)_2SO_3K$ | $CH_2CO_2H$ | 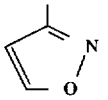 |
| I-24 | 5-Cl | $(CH_2)_2SO_3K$ | $CH_2CO_2H$ | 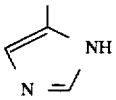 |
| I-25 | 5-Cl | $(CH_2)_2SO_3K$ | $CH_2CO_2H$ | 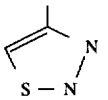 |
| I-26 | 5-Cl | $(CH_2)_2SO_3K$ | $CH_2CO_2H$ | 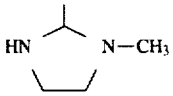 |

-continued
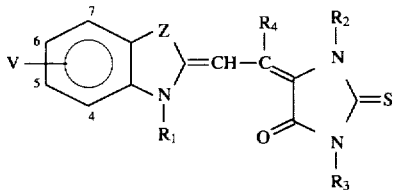
| Compound No. | V | $R_1$ | $R_2$ | $R_3$ | $R_4$ | Z |
|---|---|---|---|---|---|---|
| I-27 | 5-Cl | $(CH_2)_2SO_3K$ | 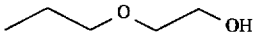 | 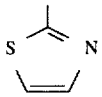 | $CH_3$ | O |
| I-28 | 5-Cl | $(CH_2)_2SO_3K$ | 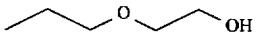 | 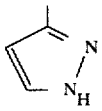 | $CH_3$ | O |
| I-29 | H | $(CH_2)_4SO_3K$ | $(CH_2)_2OH$ | 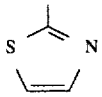 | H | S |
| I-30 | 5-$CH_3$ | $(CH_2)_3SO_3K$ | $CH_2CO_2H$ | 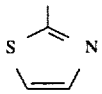 | H | S |
| I-31 | 5-Cl | $(CH_2)_2SO_3K$ | 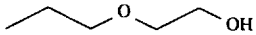 | 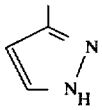 | H | S |
| I-32 | 5-$C_6H_5$ | $CH_2CONHSO_2CH_3$ | 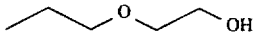 | 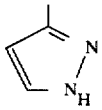 | H | S |
| I-33 | H | $CH_2CONHSO_2CH_3$ | H | 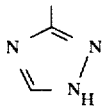 | H | S |
| I-34 | H | $(CH_2)_4SO_3K$ | $(CH_2)_2OH$ | 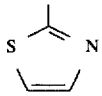 | $CH_3$ | S |
| I-35 | 5,6-$Cl_2$ | $CH_2CONHSO_2CH_3$ | $(CH_2)_2OH$ | 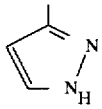 | H | N−$C_2H_5$ |
| I-36 | H | $(CH_2)_4SO_3K$ | 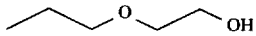 | 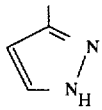 | H | N−$C_2H_5$ |
| I-37 | 5-Cl | $C_2H_5$ | 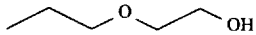 | 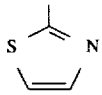 | H | Se |
| I-38 | H | $C_2H_5$ | 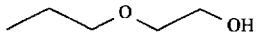 | 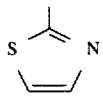 | H | Te |

-continued
| | | | | | | |
|---|---|---|---|---|---|---|
| I-39 | 5,6-$Cl_2$ | $(CH_2)_2CN$ | 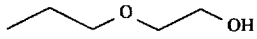 | 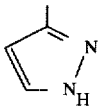 | $CH_3$ | O |
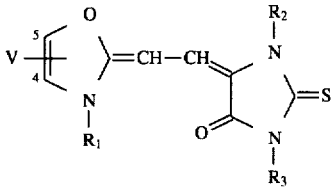
| Compound No. | V | $R_1$ | $R_2$ | $R_3$ |
|---|---|---|---|---|
| I-40 | H | $(CH_2)_3SO_3K$ | 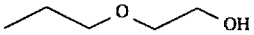 | 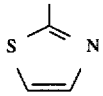 |
| I-41 | 4-$CH_3$ | $(CH_2)_3SO_3K$ | 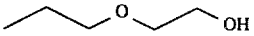 | 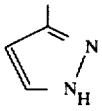 |
| I-42 | 4,5-$(CH_3)_2$ | $(CH_2)_3SO_3K$ | 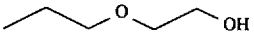 | 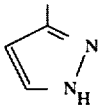 |
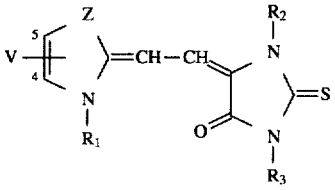
| Compound No. | V | $R_1$ | $R_2$ | $R_3$ | Z |
|---|---|---|---|---|---|
| I-43 | H | $(CH_2)_2SO_3K$ | $(CH_2)_2OH$ | 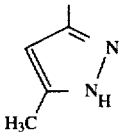 | O |
| I-44 | 4-$CH_3$ | $(CH_2)_2SO_3K$ | 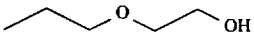 | 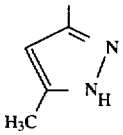 | O |
| I-45 | H | $(CH_2)_2SO_3K$ | 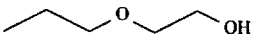 | 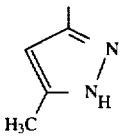 | S |
| I-46 | 4-$CH_3$ | $(CH_2)_2SO_3K$ | $(CH_2)_2OH$ | 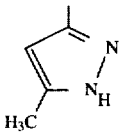 | S |

-continued
I-47
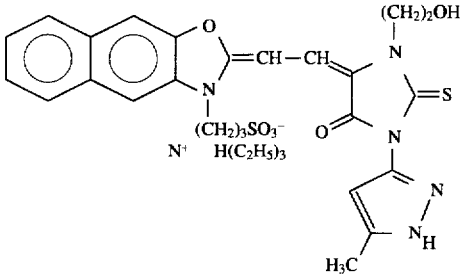
I-48
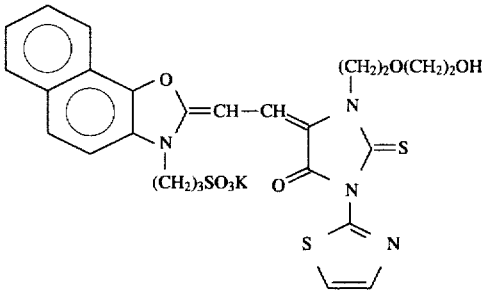
I-49
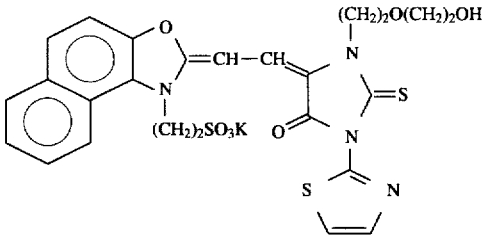
I-50
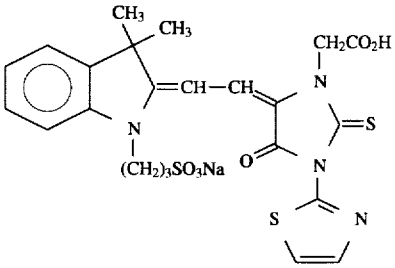
I-51
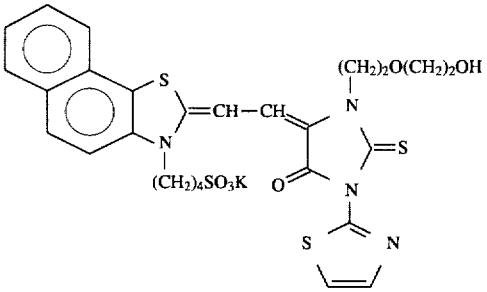
I-52
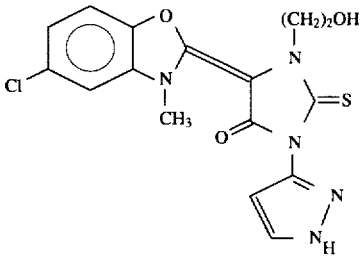

-continued
I-53
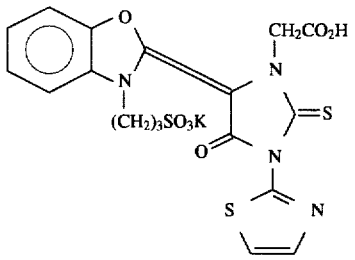
I-54
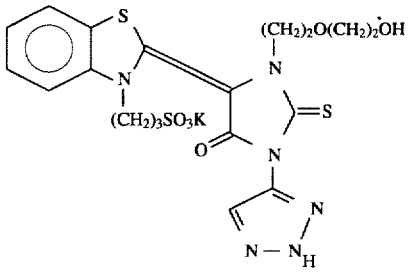
I-55
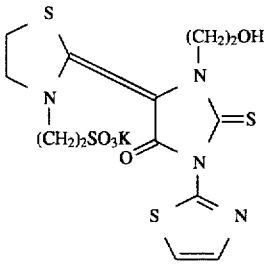
I-56
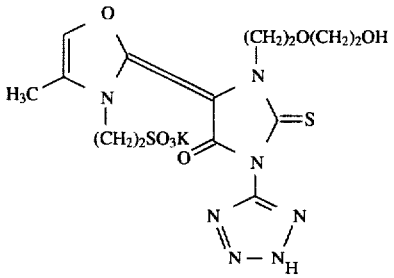
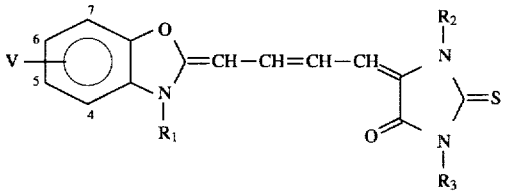
| Compound No. | V | $R_1$ | $R_2$ | $R_3$ |
|---|---|---|---|---|
| I-57 | H | $C_2H_5$ | $(CH_2)_2OH$ | 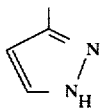 |
| I-58 | H | $(CH_2)_4SO_3K$ | $(CH_2)_2OH$ | 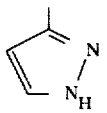 |

-continued
| | | | | |
|---|---|---|---|---|
| I-59 | 5-Cl | $C_2H_5$ | $(CH_2)_2OH$ | 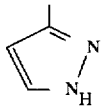 |
| I-60 | 5-Cl | $(CH_2)_4SO_3K$ | $(CH_2)_2OH$ | 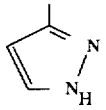 |
I-61
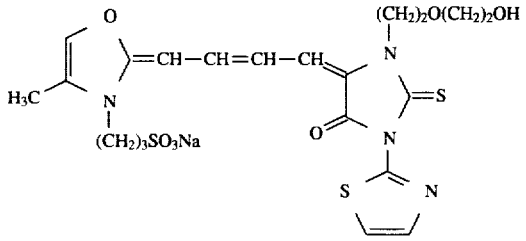
I-62
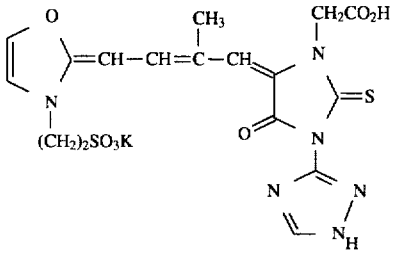
I-63
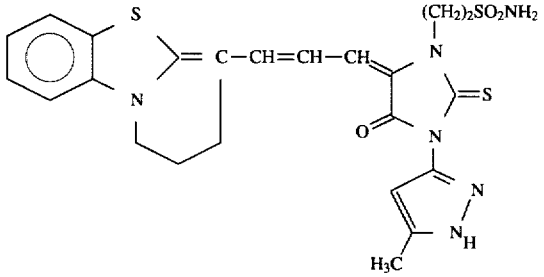
I-64
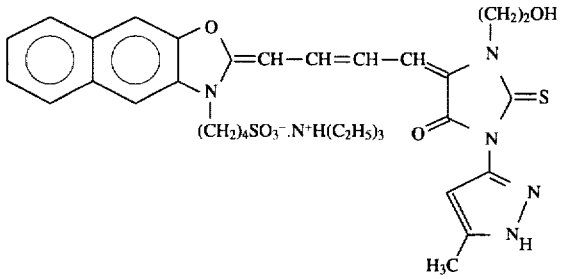
I-65
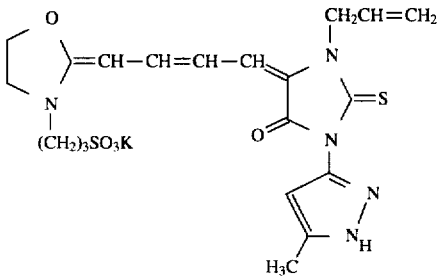

-continued

I-66

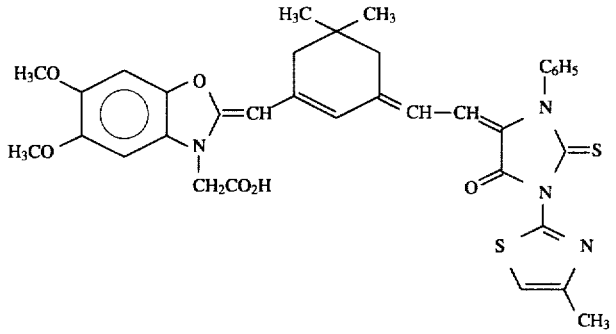

I-67

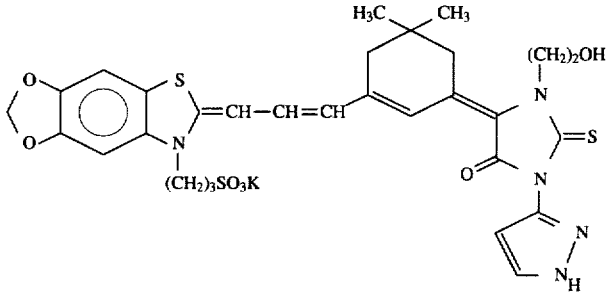

I-68

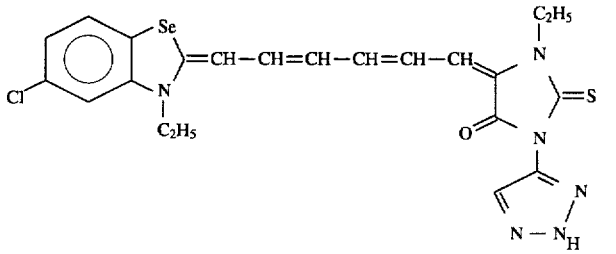

I-69

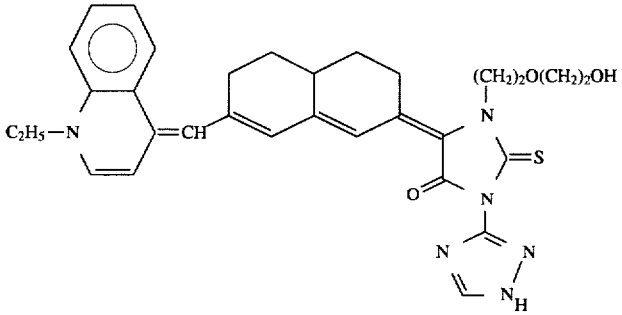

The methine compound represented by formula (I) may be synthesized by referring to the synthesis examples described in the following publications or literatures cited therein:

a) *Dokl. Akad. Nauk SSSR*, Vol. 177, p. 869 (1967);

b) F. M. Harmer, *Heterocyclic Compounds-Cyanine Dyes and Related Compounds-*, John Wiley & Sons, New York/London (1964);

c) D. M. Starmer, *Heterocyclic Compounds-Special Topics in Heterocyclic Chemistry*, pp. 482–515, John Wiley & Sons, New York/London (1977); and d) JP-B-47-4085, JP-B-46-549 and U.S. Pat. Nos. 3,625,698 and 3,567,458.

The compound represented by formula (I) may also be synthesized by using synthesis intermediates according to the following synthesis methods 1), 2) and 3).

1) A method for obtaining a dithiocarbamate by reacting an amine substituted by a nitrogen-containing 5-membered heterocyclic ring represented by $R_3$ in formula (I) with a carbon disulfide and a basic compound.

The basic compound used in this reaction is preferably an amine having from 1 to 20, preferably from 3 to 10 carbon atoms (e.g., triethylamine, diisopropylethylamine, pyridine), an alkali metal alkoxide having from 1 to 4 carbon atoms (e.g., sodium methoxide, potassium ethoxide), ammonia, an alkali metal carbonate (e.g., potassium carbonate, sodium carbonate) or an alkali metal hydroxide (e.g., sodium hydroxide, potassium hydroxide), more preferably triethylamine or pyridine.

2) A method for obtaining an alkyl dithiocarbamate by reacting the dithiocarbamate obtained in 1) above with an alkyl halide having from 1 to 6, preferably from 1 to 4 carbon atoms (e.g., methyl iodide, ethyl iodide)

3) A method for synthesizing a thiohydantoin ring compound which is a compound of formula (I) where the groups represented by $R_2$ and $R_3$ both are substituted, by reacting the alkyl dithiocarbamate compound obtained in 2) above with an alkyl aminoacetate as a compound of formula (I) where the group represented by $R_2$ is linked to the amino group.

In this reaction system, a basic compound may be contained and the basic compound is preferably an amine having from 1 to 20, preferably from 3 to 10 carbon atoms (e.g., triethylamine, diisopropylethylamine, pyridine), an alkali metal alkoxide having from 1 to 4 carbon atoms (e.g., sodium methoxide, potassium ethoxide), ammonium, an alkali metal carbonate (e.g., potassium carbonate, sodium carbonate) or an alkali metal hydroxide (e.g., sodium hydroxide, potassium hydroxide), more preferably triethylamine.

The compounds obtained by the above-described synthesis methods 1), 2) and 3) may also be used as raw materials for subsequent synthesis steps without purifying them from the reaction mixtures.

Specific synthesis examples are described below.

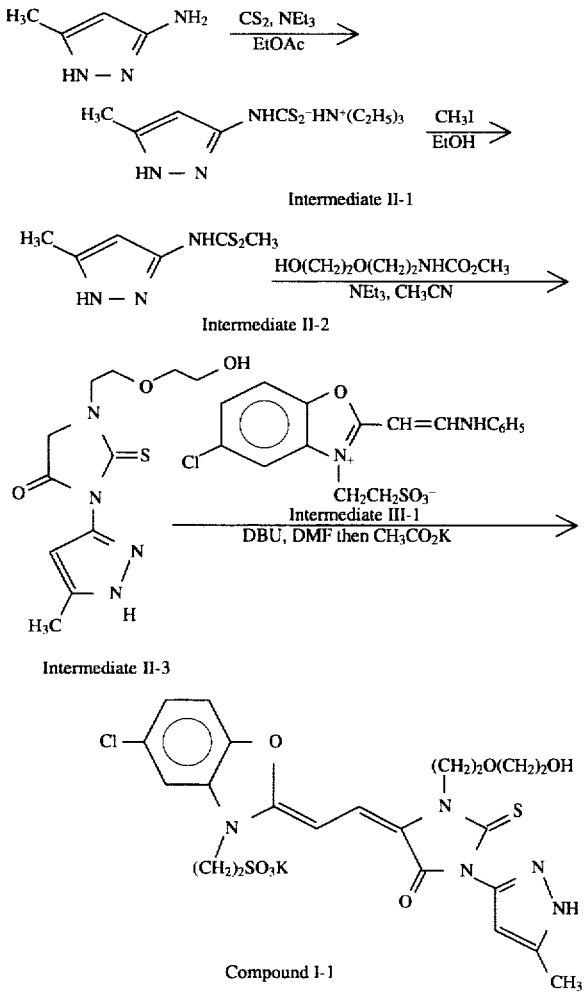

Synthesis of Intermediate II-1:

7.9 g (81.3 mmol) of 3-amino-5-methylpyrazole and 6.8 g (89.3 mmol) of carbon disulfide were taken into a 100-ml flask and dissolved in 50 ml of ethyl acetate. 9.1 g (89.9 mmol) of triethylamine was added thereto and stirred at 25° C., then immediately white crystals were precipitated. The stirring was continued for 3 hours and the crystals produced were collected by filtration and washed with 100 ml of ethyl acetate to obtain 19.3 g as a yield of 86% of triethylammonium 3-(5-methylpyrazole)dithiocarbamate (Intermediate II-1).

$^1$H-NMR (DMSO) δ: 1.11 (9H, t, J=7 Hz), 2.10 (3H, s), 2.93 (6H, m), 3.30 (3H, brs), 5.13 (s), 6.97 (brs)

m.p.: 108°–111° C.

Synthesis of Intermediate II-2

17.3 g (63.0 mmol) of Intermediate II-1 was taken into a 200-ml three-neck flask and suspended by adding thereto 20 ml of ethanol. To the reaction vessel kept on a water bath, 9.4 g (63.0 mmol) of methyl iodide (95%) previously dissolved in 5 ml of ethanol was added dropwise. After allowing them to react at 25° C. for 1 hour, 150 ml of water was added and the crystals produced were collected by filtration and washed with 200 ml of water. The crystals were dried to obtain 10.8 g as a yield of 92% of methyl 3-(5-methylpyrazole)dithiocarbamate (Intermediate II-2).

$^1$H-NMR (DMSO) δ: 2.71 (3H, s), 3.29 (3H, s), 5.91 (brs), 6.85 (brs)

m.p. 183°–186° C.

Synthesis of Compound I-1:

4.6 g (24 mmol) of methyl N-(2-hydroxyethoxyethyl)-2-aminoacetate, 3.8 g (20 mmol) of Intermediate II-2 and 20 ml of acetonitrile were taken into a 100-ml three-neck flask with a trap of aqueous sodium hypochlorite solution and thereto 3 g of triethylamine was added dropwise. After heating them 100° C. for 5 hours, the solvent was distilled off under reduced pressure to obtain 7.7 g of a brown oily product containing Intermediate II-3. As a result of an HPLC analysis, the oily product contained 76% of Intermediate II-3.

1.5 g of the resulting oily product, 1.7 g (5 mmol) of 2-(2-(2-anilinovinyl)-5-chlorobenzoxazolio)ethanesulfonate (Intermediate III-1) and 20 ml of DMF were taken into a 100-ml flask and formed into a suspension solution at 25° C. 760 mg (5 mmol) of 1,8-diazabicyclo[5.4.0]-7-undecene dissolved in 5 ml of DMF was added thereto dropwise and stirred at 90° C. for 30 minutes. The reaction mixture was filtered and to the filtrate, 1 g of potassium acetate dissolved in 50 ml of ethanol was added and further 30 ml of isopropyl alcohol was added dropwise to precipitate orange red crystals. The resulting crystals were collected by filtration, washed with 20 ml of ethanol, recrystallized with methanol and purified to obtain 790 mg of Compound I-1.

$\lambda_{max}$ (MeOH): 488.5 nm ($\epsilon$=7.92×10$^4$)

m.p.: 310° C. or higher

Other compounds represented by formula (I) for use in the present invention can also be easily synthesized by one skilled in the art according to the same method.

The compound represented by formula (I) of the present invention may be present in any layer of a silver halide photographic material, however, it is preferably present in a hydrophilic colloid layer containing light-sensitive silver halide grains (i.e., a light-sensitive silver halide emulsion layer) in such a state that the compound is adhering to the light-sensitive silver halide grains.

The compound represented by formula (I) of the present invention may be incorporated into a silver halide emulsion of the present invention by dispersing it directly into the emulsion or by dissolving it in a sole or mixed solvent of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide and then adding the solution to the emulsion.

Also, the compound may be incorporated into the emulsion according to a method where a dye is dissolved in a volatile organic solvent, the solution is dispersed in water or a hydrophilic colloid and the dispersion is added to the emulsion as described in U.S. Pat. No. 3,469,987, a method where a water-insoluble dye is dispersed in a water-soluble solvent without dissolving the dye and the dispersion is added to the emulsion as described in JP-B-46-24185, a method where a dye is dissolved in an acid and the solution is added to the emulsion or formed into an aqueous solution in the presence of an acid or a base and then added to the emulsion as described in JP-B-44-23389, JP-B-44-27555 and JP-B-57-22091, a method where the compound is formed into an aqueous solution or a colloid dispersion in the presence of a surface active agent and the aqueous solution or dispersion is added to the emulsion as described in U.S. Pat. Nos. 3,822,135 and 4,006,026, a method where a dye is directly dispersed in a hydrophilic colloid and the dispersion is added to the emulsion as described in JP-A-53-102733 and JP-A-58-105141 or a method where a dye is dissolved using a compound capable of red-shift and the solution is added to the emulsion as described in JP-A-51-74624.

An ultrasonic wave may also be used in the dissolution.

The sensitizing dye for use in the present invention may be added to a silver halide emulsion of the present invention at any step known to be useful during the preparation of emulsion. For example, the dye may be added at a step during grain formation of silver halide and/or before desalting or at a step during desalting and/or between after desalting and before initiation of chemical ripening as disclosed in U.S. Pat. Nos. 2,735,766, 3,628,960, 4,183,756 and 4,225,666, JP-A-58-184142 and JP-A-60-196749, or the dye may be added at any time or step before coating of the emulsion such as immediately before or during chemical ripening or after chemical ripening but before coating as described in JP-A-58-113920. Also, the same compound only or in combination with a compound having different structure may be added in installments, for example, a part during grain formation and the remnant during chemical ripening or after the completion of chemical ripening, or a part before or during chemical ripening and the remnant after the completion of chemical ripening as described in U.S. Pat. No. 4,225,666 and JP-A-58-7629, and the kind of compounds added in installments or of the combination of compounds may be changed.

The use amount of the compound represented by formula (I) of the present invention varies depending upon the shape or size of a silver halide grain but it is from 0.1 to 4 mmol, preferably from 0.2 to 2.5 mmol, per mol of silver halide. The compound may also be used in combination with other sensitizing dye.

The silver halide emulsion prepared according to the present invention may be applied to a black-and-white photographic material and also to a color photographic material. Examples of the black-and-white photographic material include film as a light-sensitive material for painting, X-ray film and film for general photographing and examples of the color photographic film include color paper, film for color photographing and color reversal film. It is preferred to use the emulsion of the present invention in an ultra-high contrast silver halide photographic material for use in photomechanical process.

The color light-sensitive material to which the present invention is applied may suffice if it has at least one light-sensitive layer on the support. A typical example thereof is a silver halide photographic material comprising a support having thereon at least one light-sensitive layer consisting of a plurality of silver halide emulsion layer having substantially the same spectral sensitivity but different light sensitivities, wherein the light-sensitive layer is a unit light-sensitive layer having spectral sensitivity to any of blue light, green light and red light. In the case of a multi-layer silver halide color photographic material, generally, a red-sensitive unit layer, a green-sensitive unit layer and a blue-sensitive unit layer are provided in this order from the support side. However, depending upon the purpose, the above arrangement order may be reversed or a layer having different light sensitivity may be superposed between layers having the same spectral sensitivity. A light-insensitive layer may be provided between the above-described silver halide light-sensitive layers, as an uppermost layer or as the lowermost layer. These layers may contain couplers, DIR compounds or color mixing inhibitors which will be described later. A plurality of silver halide emulsion layers constituting each unit light-sensitive layer preferably has a two-layer structure consisting of a high-sensitivity emulsion layer and a low-sensitivity emulsion layer provided such that the light sensitivity is lowered in sequence towards the support as described in German Patent 1,121,470 and British Patent 923,045. Further, it may also be possible to provide a low-sensitivity emulsion layer farther from the support and a high-sensitivity emulsion layer nearer to the support as described in JP-A-57-112751, JP-A-62-200350 and JP-A-62-206541, JP-A-62-206543.

Specific examples of the layer arrangement include an order, from the farthest side to the support, of a low-sensitivity blue-sensitive layer (BL)/a high-sensitivity blue-sensitive layer (BH)/a high-sensitivity green-sensitive layer (GH)/a low-sensitivity green-sensitive layer (GL)/a high-sensitivity red-sensitive layer (RH)/a low-sensitivity red-sensitive layer (RL), an order of BH/BL/GL/GH/RH/RL and an order of BH/BL/GH/GL/RL/RH.

Also, as described in JP-B-55-34932, a blue-sensitive layer/GH/RH/GL/RL may be arranged in this order from the farthest side to the support. Further, as described in JP-A-56-25738 and JP-A-62-63936, a blue-sensitive layer/GL/RL/GH/RH may be arranged in this order from the farthest side to the support.

An arrangement consisting of three layers different in the light sensitivity may be taken as described in JP-B-49-15495 where a silver halide emulsion layer having the highest light sensitivity is provided as an upper layer, a silver halide emulsion layer having a light sensitivity lower than that of the upper layer as a medium layer and a silver halide emulsion layer having a light sensitivity lower than that of the medium layer as a lower layer so that the light sensitivity is lowered in sequence towards the support. Even in the case when such a three layer structure having different light sensitivities is used, as described in JP-A-59-202464, a medium-sensitivity emulsion layer/a high-sensitivity emulsion layer/a low-sensitivity emulsion layer may be provided in this order from the farthest side to the support in the same spectrally sensitized layer.

In addition, an order of a high-sensitivity emulsion layer/a low-sensitivity emulsion layer/a medium-sensitivity emulsion layer or an order of a low-sensitivity emulsion layer/a medium-sensitivity emulsion layer/a high-sensitivity emulsion layer may also be used. In the case of four or more layer structure, the layer arrangement may also be changed as described above.

In order to improve color reproducibility, a donor layer (CL) having an interlayer effect which is different in the spectral sensitivity distribution from the main light-sensitive layers such as BL, GL and RL, is preferably provided adjacent to or in the vicinity of a main light-sensitive layer as described in U.S. Pat. Nos. 4,663,271, 4,705,744 and 4,707,436, JP-A-62-160448 and JP-A-63-89850.

There is no particular restriction on other additives to be added in the photographic material to which the emulsion of the present invention is applied and examples thereof are described in *Research Disclosure* Vol. 176, Item 17643 (RD17643) and ibid., Vol. 187, Item 18716 (RD18716).

A nucleating agent is preferably used in the light-sensitive material of the present invention.

The hydrazine compound as a nucleating agent which can be used include those described in *Research Disclosure* Item 23516, p. 346 (November, 1983), references cited therein, U.S. Pat. No. 4,080,207 and JP-A-2-77057. The addition amount of the hydrazine compound as a nucleating agent of the present invention is preferably from $1\times10^{-6}$ to $5\times10^{-2}$ mol, more preferably $1\times10^{-5}$ to $2\times10^{-2}$ mol, per mol of silver halide.

As the redox compound which releases a development inhibitor upon oxidation, those. described, for example, in JP-A-61-213847 and JP-A-62-260153 can be used. The redox compound is used in an amount of from $1\times10^{-6}$ to $5\times10^{-2}$ mol, preferably from $1\times10^{-5}$ to $1\times10^{-2}$ mol, per mol of silver halide the redox compound may be dissolved in an appropriate water-miscible organic solvent such as alcohols (e.g., methanol, ethanol, propanol, fluorinated alcohol), ketones (e.g., ethyl methyl ketone), dimethylformamide, acetone, dimethylsulfoxide or methyl cellosolve, before use. Also, the redox compound may be used by dissolving it according to a well-known emulsion-dispersion method using an oil such as dibutyl phthalate, tricresyl phosphate, glyceryl triacetate or diethyl phthalate or an auxiliary solvent such as ethyl acetate or cyclohexanone and mechanically forming the solution into an emulsion dispersion. Further, it may be used by dispersing a redox compound powder in water according to a method known as a solid dispersion method by means of a ball mill, a colloid mill or an ultrasonic wave.

The halogen composition of the silver halide emulsion for use in the present invention is not particularly limited, however, silver chlorobromide or silver iodochlorobromide having a silver chloride content of 50 mol % or more is preferred. The silver iodide content is 3 mol % or less, preferably 0.5 mol % or less.

The silver halide emulsion for use in the present invention is preferably a monodisperse emulsion having a coefficient of variation of 20% or less, more preferably 15% or less. The coefficient of variation (%) as used herein means a value obtained by dividing the standard deviation of grain size by an average grain size and multiplying the result by 100. The average grain size of grains in the monodisperse silver halide emulsion is 0.5 μm or less, more preferably from 0.1 to 0.4 μm.

The monodisperse silver halide emulsion is prepared by various methods known in the field of a silver halide photographic material. For example, the emulsion may be prepared by the methods described in P. Glafkides, *Chimie et Physique Photographique*., Paul Montel (1967), G. F. Duffin *Photographic Emulsion Chemistry*, The Focal Press (1966) and V. L. Zelikman et al., *Makine and Coating Photographic Emulsion*, The Focal Press (1964).

A water-soluble silver salt (e.g., aqueous silver nitrate solution) may be reacted with an aqueous halogen salt solution by a single jet method, a double jet method or a combination of these methods. A control double jet method as one form of the double jet method, where the pAg in a liquid phase in which silver halide is produced is kept constant, may also be used. It is also preferred to form grains using a so-called silver halide solvent such as ammonia, thioether or tetra-substituted thiourea.

Among these, preferred is a tetra-substituted thiourea which is described in JP-A-53-82408 and JP-A-55-77737. Preferred thiourea compound includes tetramethylthiourea and 1,3-dimethyl-2-imidazolidinethione.

According to a control double jet method or a grain formation method using a silver halide solvent, a silver halide emulsion having a regular crystal form and a narrow grain size distribution can be easily prepared and these methods are an effective means for preparing an emulsion for use in the present invention.

The monodisperse emulsion preferably has a regular crystal form such as cubic, octahedral or tetradecahedral form, with the cubic form being preferred. The silver halide grain may comprise a phase uniform or different between the inside and the surface layer thereof.

The monodisperse emulsion which can be used in the present invention is preferably subjected to chemical sensitization. The chemical sensitization may be conducted by a well-known method such as sulfur sensitization, reduction sensitization or gold sensitization. These sensitization methods may be used individually or in combination. Preferred chemical sensitization method is gold-sulfur sensitization.

As the sulfur sensitizer, a sulfur compound contained in gelatin or other various sulfur compounds such as thiosulfate, thiourea, thiazole and rhodanine may be used. Specific examples thereof include those described in U.S. Pat. Nos. 1,574,944, 2,278,947, 2,410,689, 2,728,668, 3,501,313 and 3,656,955. The sulfur compound is preferably a thiosulfate or a thiourea compound. The pAg at the chemical sensitization is preferably 8.3 or less, preferably from 7.3 to 8.0. Also, a method where a polyvinylpyrrolidone and a thiosulfate are used in combination as reported in Moisar, *Klein Gelatine. Proc. Syme.* 2nd, pp. 301–309 (1970) may provide good results.

Gold sensitization is representative as the noble metal sensitization and a gold compound, mainly, a gold complex salt, is used there. A complex salt of a noble metal other than gold, such as platinum, palladium or iridium may also be used without any problem. Specific examples thereof are described in U.S. Pat. No. 2,448,060 and British Patent 618,061.

Examples of the support properly used in the present invention are described in RD No. 17643, page 28, ibid., No. 18716, from page 647, right column to page 648, left column and ibid., No. 307105, page 879.

As a binder or a protective colloid of a photographic emulsion, gelatin is advantageously used, however, other hydrophilic colloid may be used. For example, a gelatin derivative, a graft polymer of gelatin with other high polymer, a protein such as albumin and casein, a cellulose derivative such as hydroxyethyl cellulose, carboxymethyl cellulose and cellulose sulfate, a sodium alginate, a saccharide derivative such as starch derivative or various synthetic hydrophilic high polymer materials such as a homopolymer or copolymer of polyvinyl alcohol, polyvinyl alcohol partial acetal, poly-N-vinylpyrrolidone, polyacrylate, polymethacrylate, polyacrylamide, polyvinylimidazole and polyvinylpyrazole may be used.

The gelatin may be either a lime-processed gelatin or an acid-processed gelatin and in addition, a gelatin hydrolysate or a gelatin enzymolysis product may be used.

In order to obtain photographic properties such as ultra-high contrast and high sensitivity using a silver halide light-sensitive material of the present invention, a conventional infectious developer or a high alkali developer having a pH close to 13 described in U.S. Pat. No. 2,419,975 needs not be used but a stable developer can be used.

More specifically, the silver halide light-sensitive material of the present invention can provide a satisfactory high-contrast negative image using a developer containing a sulfite ion as a preservative in an amount of from 0.15 to 2.5 mol/l and having a pH of 9.6 to 12.0.

The developing agent for use in the developer used in the present invention is not particularly restricted, however, in view of easiness in achieving good halftone dot quality, a dihydroxybenzene is preferably used and a combination of a dihydroxybenzene and a 1-phenyl-3-pyrazolidone or a combination of a dihydroxybenzene and a p-aminophenol may also be used.

Examples of the dihydroxybenzene developing agent include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone, with hydroquinone being preferred.

Examples of the 1-phenyl-3-pyrazolidone or its derivative developing agent include 1-phenyl-3-pyrazolidone, 1-phenyl-4,4-dimethyl-4-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-amino-phenyl-4,4-dimethyl-3-pyrazolidone and 1-p-tolyl-4,4-dimethyl-3-pyrazolidone.

Examples of the p-aminophenolic developing agent include N-methyl-p-aminophenol, p-aminophenol, N-(β-hydroxy-ethyl)-p-aminophenol, N-(4-hydroxyphenyl)glycine, 2-methyl-p-aminophenol and p-benzylaminophenol, with N-methyl-p-aminophenol being preferred.

The developing agent is usually used in an amount of preferably from 0.05 to 0.8 mol/l. In the case where a combination of a dihydroxybenzene with a 1-phenyl-3-pyrazolidone or a p-aminophenol is used, it is preferred to use the former in an amount of from 0.05 to 0.5 mol/l and the latter in an amount of 0.06 mol/l or less.

Examples of the sulfite preservative for use in the present invention include sodium sulfite, potassium sulfite, lithium sulfite, ammonium sulfite, sodium bisulfite, potassium metabisulfite and formaldehyde sodium bisulfite. The concentration of sulfite is preferably from 0.15 to 2.5 mol/l, more preferably from 0.3 to 2.5 mol/l.

The alkali agent used for setting the pH includes a pH adjusting agent and a buffer such as sodium hydroxide, potassium hydroxide, sodium carbonate, potassium carbonate, sodium tertiary phosphate and potassium tertiary phosphate. The pH of the developer is set between 9.6 and 12.0.

In addition to the foregoing, additives which can be used include a compound such as boric acid and borax, a development inhibitor such as sodium bromide, potassium bromide and potassium iodide, an organic solvent such as ethylene glycol, diethylene glycol, triethylene glycol, dimethylformamide, methyl cellosolve, hexylene glycol, ethanol and methanol, and an antifoggant or a black pepper inhibitor such as an indazole-based compound, e.g., 1-phenyl-5-mercaptotetrazole, 5-nitroindazole, and a benztriazole compound, e.g., 5-methylbenztriazole, and further, if desired, a toning agent, a surface active agent, a defoaming agent, a hard water softening agent, a hardening agent or an amino compound described in JP-A-56-106244 may be added.

The developer of the present invention may use the compounds described in JP-A-56-24347 as a silver stain inhibitor. The compounds described in JP-A-61-267759 may also be used as a dissolution aid added to the developer. Further, the compounds described in JP-A-60-93433 or compounds described in JP-A-62-186259 may be used as a pH buffer used in the developer.

The fixing solution may have a commonly used composition. The fixing agent may be a thiosulfate or a thiocyanate or other than these, an organic sulfur compound known to provide an effect as a fixing agent may also be used. The fixing solution may contain a water-soluble aluminum (e.g., aluminum sulfate, alum) as a hardening agent. The water-soluble aluminum salt is usually used in an amount of from 10 to 80 mmol/l. Further, a trivalent iron compound may also be used as an oxidizing agent in the form of a complex with an ethylenediaminetetraacetic acid.

The development processing temperature is usually from 18° to 50° C., preferably from 25° to 43° C.

There is no particular limitation on various additives used in the light-sensitive material of the present invention and for example, those described in the following portion may be preferably used.

| Item | Pertinent Portion |
|---|---|
| 1) Nucleation accelerator | formulae (II-m) to (II-p) and compounds II-1 to II-22 of JP-A-2-103536, from page 9, right upper column, line 13 to page 16, left upper column, line 10; compounds described in JP-A-1-179939 |
| 2) Surface active agent | JP-A-2-12236, page 9, from right upper column, line 7 to right lower column, line 7; JP-A-2-18542, from page 2, left lower column, line 13 to page 4, right lower column, line 18 |
| 3) Antifoggant | JP-A-2-103536, from page 17, right lower column, line 19 to page 18, right upper column, line 4 and page 18, right lower column, lines 1 to 5; thiosulfinic acid compounds described in JP-A-1-237538 |
| 4) Polymer latex | JP-A-2-103536, page 18, left lower column, lines 12 to 20 |
| 5) Compound having acid group | JP-A-2-103536, from page 18, right lower column, line 6 to page 19, left upper column, line 1 |
| 6) Matting agent, lubricant, plasticizer | JP-A-2-103536, page 19, from left upper column, line 15 to right upper column, line 15 |
| 7) Hardening agent | JP-A-2-103536, page 18, right upper column, lines 5 to 17 |
| 8) Dye | dyes described in JP-A-2-103536, page 17, right lower column, lines 1 to 18; solid dyes described in JP-A-2-294638 and JP-A-5-11382 |
| 9) Binder | JP-A-2-18542, page 3, right lower column, lines 1 to 20 |
| 10) Black pepper inhibitor | compounds described in U.S. Pat. No. 4,956,257 and JP-A-1-118832 |
| 11) Monomethine compound | compounds represented by formula (II) (particularly, Compounds II-1 to II-26) of JP-A-2-287532 |
| 12) Dihydroxybenzenes | compounds described in JP-A-3-39948, from page 11, left upper column to page 12, left lower column and EP-A-452772 |

The present invention will be described below in greater detail by referring to Examples, but the present invention should not be construed as being limited thereto.

EXAMPLE 1

Emulsion A:

A 0.13 mol/l (hereinafter referred to as "M") aqueous silver nitrate solution and an aqueous halogen salt solution containing $(NH_4)_2Rh(H_2O)Cl_5$ in an amount corresponding to $1\times10^{-7}$ mol/mol-Ag, $K_2IrCl_6$ in an amount corresponding to $2\times10^{-7}$ mol/mol-Ag, 0.04M potassium bromide and 0.09M sodium chloride were added to an aqueous gelatin solution containing 0.08M sodium chloride and $1.7\times10^{-4}$M 1,3-dimethyl-2-imidazolidinethione by a double jet method while stirring at 38° C. over 12 minutes to effect nucleation to thereby obtain silver chlorobromide grains having an average grain size of 0.15 μm and a silver chloride content of 70 mol %. Subsequently, in the same manner, a 0.87M aqueous silver nitrate solution and an aqueous halogen salt solution containing 0.26M potassium bromide and 0.65M sodium chloride were added by a double jet method over 20 minutes.

Thereafter, the emulsion was subjected to conversion by adding $1\times10^{-3}$ mol of KI solution and then to water washing according to a normal flocculation method, 40 g of gelatin was added, the pH and the pAg were adjusted to 6.5 and 7.5, respectively, 8 mg/mol-Ag of sodium benzenethiosulfonate, 5 mg/mol-Ag of sodium thiosulfate and 8 mg/mol-Ag of chloroauric acid were added to effect chemical sensitization under heating at 60° C. for 60 minutes and then thereto 150 mg of 6-methyl-4-hydroxy-1,3,3a,7-tetrazaindene was added as a stabilizer. The resulting grains were a silver chlorobromide cubic grain having an average grain size of 0.27 μm and a silver chloride content of 70 mol % (coefficient of fluctuation: 10%).

Emulsion B:

A 0.13M aqueous silver nitrate solution and an aqueous halogen salt solution containing $K_2Ru(NO)Cl_5$ in an amount corresponding to $1\times10^{-7}$ mol/mol-Ag, $K_3IrCl_6$ in an amount corresponding to $2\times10^{-7}$ mol/mol-Ag, 0.052M potassium bromide and 0.078M sodium chloride were added to an aqueous gelatin solution containing 0.08M sodium chloride and $1.7\times10^{-4}$M 1,3-dimethyl-2-imidazolidinethione by a double jet method while stirring at 45° C. over 12 minutes to effect nucleation to thereby obtain silver chlorobromide grains having an average grain size of 0.15 μm and a silver chloride content of 60 mol %. Subsequently, in the same manner, a 0.87M aqueous silver nitrate solution and an aqueous halogen salt solution containing 0.34M potassium bromide and 0.52M sodium chloride were added by a double jet method over 20 minutes.

Thereafter, the emulsion was subjected to conversion by adding thereto $1\times10^{-3}$ mol of a KI solution and then to water washing by a normal flocculation method, 40 g of gelatin was added, the pH and the pAg were adjusted to 6.5 and 7.5, respectively, 8 mg/mol-Ag of sodium benzenethiosulfonate, 5 mg/mol-Ag of sodium thiosulfate and 8 mg/mol-Ag of chloroauric acid were added to effect chemical sensitization under heating at 60° C. for 60 minutes and then 150 mg of 4-hydroxy-6-methyl-1,3,3a,7-tetrazaindene was added as a stabilizer. The resulting grains were a silver chlorobromide cubic grain having an average grain size of 0.27 μm and a silver chloride content of 60 mol % (coefficient of fluctuation: 10%).

Emulsion C:

A 0.13M aqueous silver nitrate solution and an aqueous halogen salt solution containing $K_2Ru(NO)Cl_6$ in an amount corresponding to $1\times10^{-7}$ mol/mol-Ag, $K_3IrCl_6$ in an amount corresponding to $2\times10^{-7}$ mol/mol-Ag, 0.078M potassium bromide and 0.052M sodium chloride were added to an aqueous gelatin solution containing 0.08M sodium chloride by a double jet method while stirring at 45° C. over 12 minutes to effect nucleation to thereby obtain silver chlorobromide grains having an average grain size of 0.15 μm and a silver chloride content of 70 mol %. Subsequently, in the same manner, a 0.87M aqueous silver nitrate solution and an aqueous halogen salt solution containing 0.522M potassium bromide and 0.348M sodium chloride were added by a double jet method over 20 minutes.

Thereafter, the emulsion was subjected to conversion by adding thereto $1\times10^{-3}$ mol of a KI solution and then to water washing by a normal flocculation method, 40 g of gelatin was added, the pH and the pAg were adjusted to 6.5 and 7.5, respectively, 8 mg/mol-Ag of sodium benzenethiosulfonate, 5 mg/mol-Ag of sodium thiosulfate and 8 mg/mol-Ag of chloroauric acid were added to effect chemical sensitization under heating at 60° C. for 60 minutes and then 150 mg of 4-hydroxy-6-methyl-1,3,3a,7-tetrazaindene was added as a stabilizer. The resulting grains were a silver chlorobromide cubic grain having an average grain size of 0.27 μm and a silver chloride content of 40 mol % (coefficient of fluctuation: 11%).

Emulsion D:

To an aqueous gelatin solution kept at 50° C., 1 mol of an aqueous silver nitrate solution and an aqueous potassium iodide solution and an aqueous potassium bromide solution each containing $1.2\times10^{-7}$ mol/mol-Ag of $(NH_4)_2Rh(H_2O)Cl_5$ were added simultaneously in the presence of ammonia over 60 minutes while keeping the pAg at 7.8 to obtain a cubic monodisperse emulsion having an average grain size of 0.25 μm and an average silver iodide content of 1 mol %. The emulsion was desalted by a flocculation method, 40 g of gelatin was added, the pH and the pAg were adjusted to 6.0 and 8.5, respectively, 5 mg of sodium thiosulfate and 6 mg of chloroauric acid were added to effect chemical sensitization under heating at 60° C. for 60 minutes and then 150 mg of 4-hydroxy-6-methyl-1,3,3a,7-tetrazaindene was added as a stabilizer (coefficient of variation: 9%).

Emulsion E:

A 1.0M aqueous silver nitrate solution and an aqueous halogen salt solution containing $3\times10^{-7}$ mol/mol-Ag of $(NH_4)_2Rh(H_2O)Cl_5$, 0.3M potassium bromide and 0.75M sodium chloride were added to an aqueous gelatin solution containing 0.08M sodium chloride and $1.7\times10^{-4}$M 1,3-dimethyl-2-imidazolinethione by a double jet method while stirring at 45° C. over 30 minutes to obtain silver chlorobromide grains having an average grain size of 0.28 μm and a silver chloride content of 70 mol %. The emulsion was then subjected to water washing by a normal flocculation method, 40 g of gelatin was added, the pH and the pAg were adjusted to 6.5 and 7.5, respectively, 5 mg/mol-Ag of sodium thiosulfate and 8 mg/mol-Ag of chloroauric acid were added to effect chemical sensitization under heating 60° C. for 60 minutes and then 150 mg of 4-hydroxy-6-methyl-1,3,3a,7-tetrazaindene was added as a stabilizer. The resulting grains were a silver chlorobromide cubic grain having an average grain size of 0.28 μm and a silver chloride content of 70 mol % (coefficient of variation: 10%).

Preparation of Coated Sample:

The coated sample had a layer structure such that from the upper side, a protective layer, an emulsion layer 1, an interlayer, an emulsion layer 2, an antihalation layer, a support, a back layer and a back protective layer are provided.

Protective Layer: (gelatin: 0.25 g/m$^2$)

| | |
|---|---|
| $SiO_2$ Matting agent (particle size: 3.6 μm, amorphous) | 60 mg/m$^2$ |
| Snowtex C | 60 mg/m$^2$ |
| Liquid paraffin (gelatin dispersion) | 30 mg/m$^2$ |
| Sodium dodecylbenzenesulfonate | 19 mg/m$^2$ |
| N-Perfluorooctanesulfonyl-N-propylglycine potassium salt | 1.4 mg/m$^2$ |

Emulsion 1: (gelatin: 0.22 g/m$^2$)

| | |
|---|---|
| Emulsion E Ag: | 0.32 g/m$^2$ |
| Compound A capable of releasing an inhibitor shown below | 132 mg/m$^2$ |
| Compound for use in the present invention | Table 1 |
| Dye A shown below | 10 mg/m$^2$ |
| Ethyl acrylate latex (grain size: 0.1 μm) | 260 mg/m$^2$ |

Compound A:

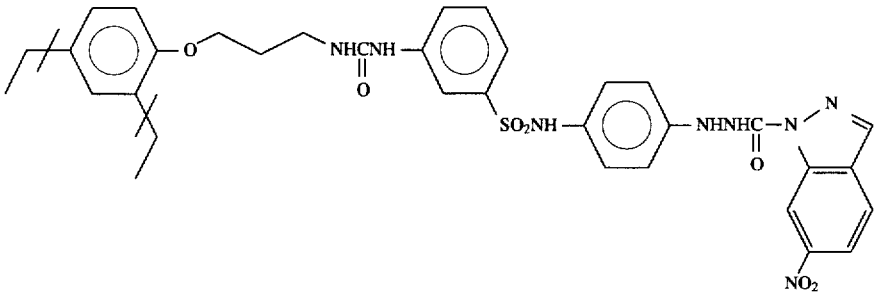

Dye A:

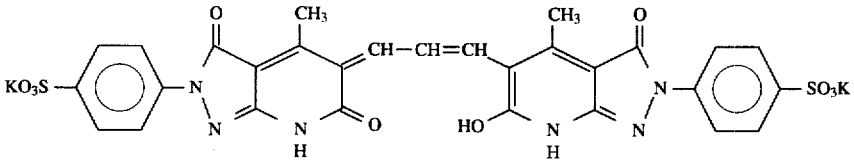

Interlayer: (gelatin: 1.20 g/m$^2$)

| | |
|---|---|
| Hydroquinone | 86 mg/m$^2$ |
| Ethylsulfonic acid | 4.3 mg/m$^2$ |
| Trimethylolpropane | 50 mg/m$^2$ |
| Dye B shown below | 67 mg/m$^2$ |
| Ethyl acrylate latex (particle size: 0.1 μm) | 380 mg/m$^2$ |

Dye B:

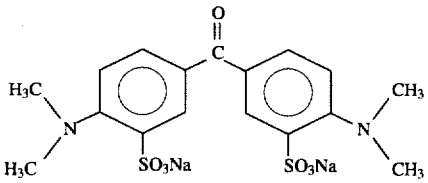

Emulsion Layer 2: (gelatin: 1.61 g/m$^2$)

| | |
|---|---|
| Emulsion (Emulsions A to E) Table 1 Ag: | 3.60 g/m$^2$ |
| Compound for use in the present invention | Table 1 |
| Hydrazine Derivative A shown below | 35 mg/m$^2$ |
| Hydrazine Derivative B shown below | 25 mg/m$^2$ |
| N-Oleyl-N-methyltaurine sodium salt | 29 mg/m$^2$ |
| Triethylammonium 3-[2-[5-phenyl-3-(4-sulfobutyl)benzoxazoline-2-ylidene-methyl]-3-naphth[1,2-d]oxazolio]-propanesulfonate | 2 mg/m$^2$ |
| Sodium 3-(5-mercaptotetrazole)-benzenesulfonate | 1.8 mg/m$^2$ |
| Compound A shown below | 2.5 mg/m$^2$ |
| Compound B shown below | 7.9 mg/m$^2$ |
| Compound C shown below | 12.7 mg/m$^2$ |
| Compound D shown below | 2.2 mg/m$^2$ |
| Ethyl acrylate latex (particle size: 0.1 μm) | 600 mg/m$^2$ |

-continued

| | |
|---|---|
| 1,2-Bis(vinylsulfonylacetamido)ethane | 81 mg/m$^2$ |

Hydrazine Derivative A:

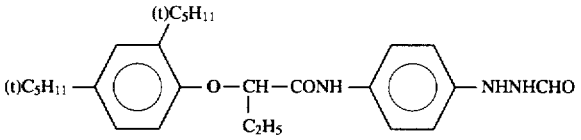

Hydrazine Derivative B:

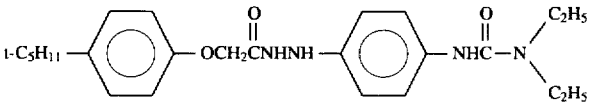

Compound A:

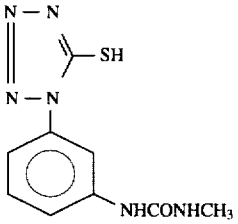

Compound B:

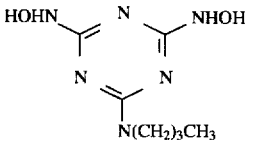

Compound C:

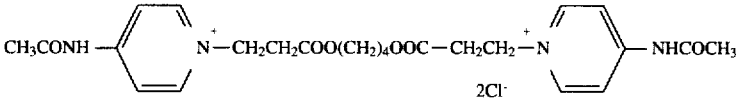

Compound D:

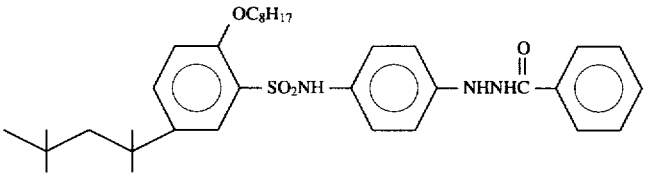

Antihalation Layer: (gelatin: 0.15 g/m$^2$)

| | |
|---|---|
| Ethyl acrylate latex (particle size: 0.1 μm) | 150 mg/m$^2$ |
| Bisvinylsulfonylmethane | 41 mg/m$^2$ |

Back Layer: (gelatin: 3.16 g/m$^2$)

| | |
|---|---|
| Compound E shown below | 38.9 mg/m$^2$ |
| Dye C shown below | 18.4 mg/m$^2$ |
| Dye D shown below | 13.9 mg/m$^2$ |
| Dye E shown below | 25.3 mg/m$^2$ |
| Dye F shown below | 53.1 mg/m$^2$ |
| Sodium dodecylbenzenesulfonate | 38.9 mg/m$^2$ |
| 1,3-Vinylsulfonyl-2-propanol | 146 mg/m$^2$ |

Compound E:

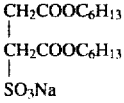

-continued
Dye C:
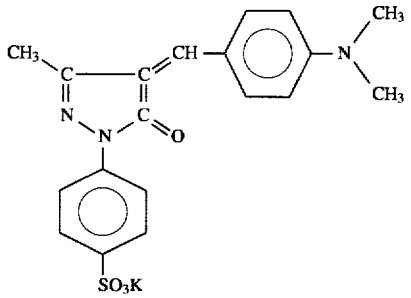
Dye D:
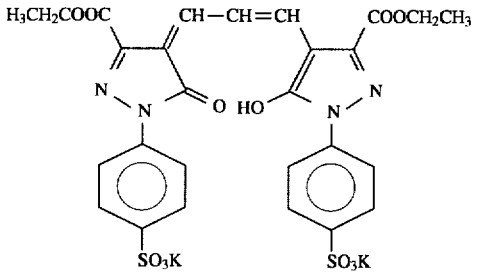
Dye E:
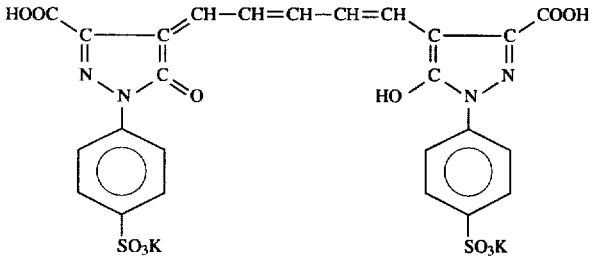
Dye F:
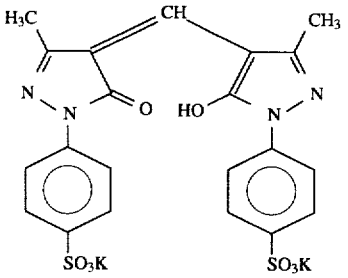
Back Protective layer: (gelatin: 1.32 g/m$^2$)
| | |
|---|---|
| Sodium dodecylbenzenesulfonate | 13.8 mg/m$^2$ |
| Polymethyl methacrylate fine particle (particle diameter: 2.8 μm) | 15 mg/m$^2$ |
| Sodium acetate | 57.7 mg/m$^2$ |
| Compound F shown below | 16 mg/m$^2$ |
| 1,3-Vinylsulfonyl-2-propanol | 60.8 mg/m$^2$ |

-continued

Compound F:

$CH_2COOC_6H_{13}$
|
$CH_2COOC_6H_{13}$
|
$SO_3Na$

Evaluation Method:

Formulation of Developer:

| | |
|---|---|
| Hydroquinone | 50.0 g |
| N-Methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzene-sulfonate | 0.2 g |
| N-n-butyldiethanolamine | 15.0 g |
| Sodium p-toluenesulfonate | 8.0 g |
| Water to make | 1 liter |
| pH adjusted to (by adding potassium hydroxide) | 11.6 |

Photographic Properties:

The thus-produced coated sample was divided into 3 parts and one part was stored at −30° C., another part at 65% RH, 50° C. for 3 days, and the remnant part under oxygen partial pressure of 5 atm at room temperature for 3 days. These samples each was subjected to exposure for sensitometry by FWH Sensitometry produced by Fuji Photo Film Co., Ltd. and processed with the above-described developer at 34° C. for 30 seconds in Automatic Developing Machine FG-660F (manufactured by Fuji Photo Film Co., Ltd.). As the fixing solution, Fixing Solution GR-F1 produced by Fuji Photo Film Co., Ltd. was used.

Each of the processed samples was determined on the fog density and the sensitivity using a densitometer manufactured by Fuji Photo Film Co., Ltd. The sensitivity was obtained as a reciprocal of an exposure amount giving a density of 1.5 in the development at 34° C. for 30 seconds and shown by a relative value to the sensitivity of a comparative sample taken as 100. The γ indicating the contrast of samples was obtained according to the following formula:

$$\gamma = (3.0 - 0.3)/[\log(\text{exposure amount giving density of } 3.0) - \log(\text{exposure amount giving density of } 0.3)]$$

Evaluation of Residual Dye Stain after Processing:

Each coated sample was subjected to the development processing under the same conditions as in the evaluation of photographic properties without passing through exposure. Evaluation was made by 5 ranks: "1" is a sample almost free of residual dye stain and "5" is a sample having a greatest residual dye stain. Samples in ranks "1" and "2" can be used in practice, samples in rank "3" may be barely used in practice in spite of the presence of residual dye stain and samples in ranks "4" and "5" cannot be used in practice.

The evaluation results are shown in Table 1.

Comparative Compound C-1:

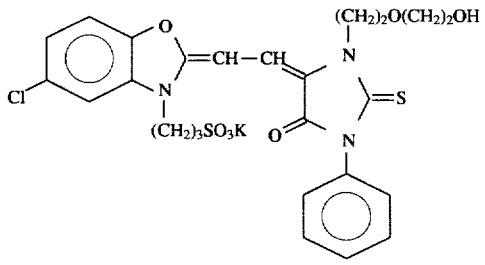

Comparative Compound C-2:

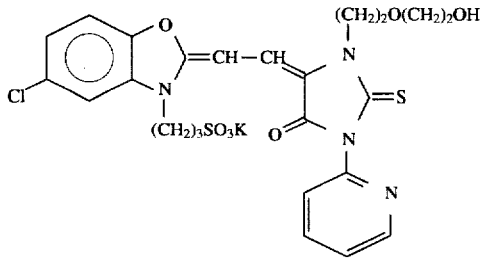

Comparative Compound C-3:

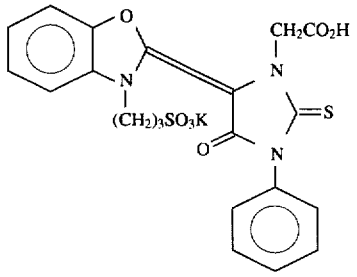

TABLE 1

| Sample No. | Emulsion in Emulsion Layer 2 | Polymethine Dye and Addition Amount ($\times 10^{-4}$ mol/mol-Ag) | | −30° C. Storage Sensitivity | Fog | γ | 65%, 50° C. Storage Sensitivity | Fog | Oxygen 5-atm Storage Sensitivity | Fog | Residual Dye Stain | |
|---|---|---|---|---|---|---|---|---|---|---|---|---|
| 1 | A | C-1 | 3.0 | 100 (standard) | 0.03 | 12 | 84 | 0.04 | 88 | 0.05 | 4 | Comparison |
| 2 | A | C-2 | " | 105 | 0.03 | 11 | 94 | 0.04 | 92 | 0.04 | 2 | Comparison |
| 3 | A | I-2 | " | 127 | 0.02 | 11 | 128 | 0.03 | 129 | 0.03 | 1 | Invention |
| 4 | A | I-10 | " | 110 | 0.04 | 12 | 112 | 0.05 | 104 | 0.04 | 1 | Invention |
| 5 | A | I-15 | " | 113 | 0.04 | 12 | 116 | 0.04 | 111 | 0.03 | 1 | Invention |
| 6 | A | I-18 | " | 102 | 0.02 | 13 | 100 | 0.02 | 105 | 0.02 | 2 | Invention |
| 7 | B | C-1 | " | 100 (standard) | 0.02 | 10 | 89 | 0.02 | 92 | 0.03 | 4 | Comparison |
| 8 | B | I-1 | " | 102 | 0.02 | 11 | 104 | 0.02 | 100 | 0.02 | 1 | Invention |
| 9 | B | I-41 | " | 125 | 0.02 | 12 | 120 | 0.02 | 119 | 0.02 | 1 | Invention |
| 10 | B | I-45 | " | 140 | 0.03 | 12 | 142 | 0.03 | 137 | 0.02 | 2 | Invention |
| 11 | C | C-1 | " | 100 (standard) | 0.03 | 11 | 91 | 0.03 | 87 | 0.04 | 3 | Comparison |
| 12 | C | I-13 | " | 100 | 0.03 | 11 | 105 | 0.03 | 98 | 0.03 | 2 | Invention |
| 13 | C | I-49 | " | 117 | 0.02 | 12 | 119 | 0.02 | 113 | 0.02 | 2 | Invention |
| 14 | D | C-3 | " | 100 (standard) | 0.02 | 10 | 90 | 0.02 | 88 | 0.04 | 4 | Comparison |
| 15 | D | I-53 | " | 107 | 0.02 | 11 | 110 | 0.02 | 102 | 0.03 | 2 | Invention |
| 16 | E | C-1 | " | 100 (standard) | 0.03 | 11 | 98 | 0.03 | 87 | 0.03 | 3 | Comparison |
| 17 | E | I-1 | " | 115 | 0.02 | 12 | 120 | 0.02 | 109 | 0.02 | 1 | Invention |

As is clearly seen from the results in Table 1, silver halide photographic materials containing a merocyanine dye for use in the present invention are high in the sensitivity as compared with comparative samples and greatly improved in the fluctuation of sensitivity under high-temperature and high-humidity conditions or in the presence of oxygen. Further silver halide photographic materials containing a merocyanine dye for use in the present invention are also superior in the residual dye stain after processing.

Thus, it would be understood that the silver halide photographic material containing a merocyanine dye for use in the present invention is high in the sensitivity and in the contrast, good in the storage stability and very reduced in the residual dye stain after development processing.

Preferred embodiments of the present invention are enumerated as follows:

(1) A silver halide photographic material comprising a support having provided thereon at least one light-sensitive silver halide emulsion layer, said at least one light-sensitive silver halide emulsion layer containing at least one compound represented by the following formula (I):

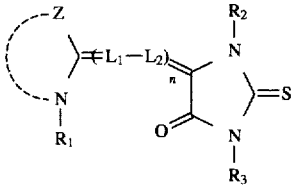

(I)

wherein Z represents an atomic group necessary for forming a 5- or 6-membered nitrogen-containing heterocyclic ring, $R_1$ represents an alkyl group, $R_2$ represents a hydrogen atom, an alkyl group, an aryl group or a heterocyclic group, $R_3$ represents a nitrogen-containing 5-membered heterocyclic ring, $L_1$ and $L_2$ each represents a methine group and n represents 0 or an integer of 1 to 3.

(2) The silver halide photographic material as described in (1), wherein Z represents a non-metallic atomic group necessary for forming an oxazole ring, a benzoxazole ring or a naphthoxazole ring each may have a substituent and n represents 0, 1 or 2.

(3) The silver halide photographic material as described in (1), wherein $R_3$ represents a nitrogen-containing 5-membered heterocyclic ring represented by the following formula (II):

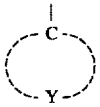

(II)

wherein Y represents a non-metallic atomic group necessary for forming a nitrogen-containing 5-membered heterocyclic ring.

(4) The silver halide photographic material as described in (2), wherein $R_3$ represents a nitrogen-containing 5-membered heterocyclic ring represented by the following formula (II):

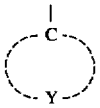

(II)

wherein Y represents a non-metallic atomic group necessary for forming a nitrogen-containing 5-membered heterocyclic ring.

(5) The silver halide photographic material as described in (1), wherein $R_3$ represents a substituted or unsubstituted 2-thiazolyl group, a substituted or unsubstituted 3-pyrazolyl group or a substituted or unsubstituted 1,2,4-triazolyl group.

(6) The silver halide photographic material as described in (2), wherein $R_3$ represents a substituted or unsubstituted 2-thiazolyl group, a substituted or unsubstituted 3-pyrazolyl group or a substituted or unsubstituted 1,2,4-triazolyl group.

(7) The silver halide photographic material as described in (1), wherein $R_3$ represents a substituted or unsubstituted 3-pyrazolyl group.

(8) The silver halide photographic material as described in (2), wherein $R_3$ represents a substituted or unsubstituted 3-pyrazolyl group.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one light-sensitive silver halide emulsion layer, said at least one light-sensitive silver halide emulsion layer containing at least one compound represented by the following formula (I):

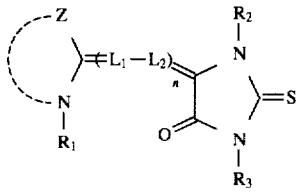

(I)

wherein Z represents an atomic group necessary for forming a 5- or 6-membered nitrogen-containing heterocyclic ring, $R_1$ represents an alkyl group, $R_2$ represents a hydrogen atom, an alkyl group, an aryl group or a heterocyclic group, $R_3$ represents a substituted or unsubstituted 3-pyrazolyl group, $L_1$ and $L_2$ each represents a methine group and n represents 0 or an integer of 1 to 3.

2. The silver halide photographic material as claimed in claim 1, wherein Z represents a non-metallic atomic group necessary for forming an oxazole ring, a benzoxazole ring or a naphthoxazole ring each may have a substituent and n represents 0, 1 or 2.

* * * * *